US006911239B2

(12) United States Patent
King et al.

(10) Patent No.: US 6,911,239 B2
(45) Date of Patent: Jun. 28, 2005

(54) RECORDING MATERIAL AND METHOD

(75) Inventors: Jeffrey Ronald King, Holmes Chapel (GB); Simon Richard John Leggett, Farnham (GB); Karen Taylor, Poynton (GB); Stefan Schüttel, Murten (CH); Meinrad Schaer,Ependes (CH)

(73) Assignees: Ilford Imaging UK Limited (GB); Ilford Imaging Switzerland GmbH (CH)

( * ) Notice: Subject to any disclaimer, the term of this patent is extended or adjusted under 35 U.S.C. 154(b) by 61 days.

(21) Appl. No.: 09/953,641

(22) Filed: Sep. 17, 2001

(65) Prior Publication Data

US 2002/0097312 A1 Jul. 25, 2002

Related U.S. Application Data

(63) Continuation-in-part of application No. 09/631,412, filed on Aug. 3, 2000, now Pat. No. 6,811,253.

(30) Foreign Application Priority Data

Aug. 4, 1999 (GB) ..... 9918265
Sep. 15, 2000 (GB) ..... 0022617

(51) Int. Cl.[7] ..... B41M 5/40

(52) U.S. Cl. ..... 428/32.25; 428/32.12; 428/32.18; 428/32.22; 428/32.27; 428/32.28; 428/32.35

(58) Field of Search ..... 428/32.12, 32.18, 428/32.22, 32.25, 32.27, 32.28, 32.35, 195, 206, 327, 500

(56) References Cited

U.S. PATENT DOCUMENTS 5,374,475 A * 12/1994 Walchli ..... 428/304.4
5,576,088 A * 11/1996 Ogawa et al. ..... 428/327
5,824,462 A * 10/1998 Ashida et al. ..... 430/531
5,858,514 A 1/1999 Bowers
5,882,755 A 3/1999 Igarashi et al.
5,885,678 A * 3/1999 Malhotra ..... 428/41.8
6,013,354 A 1/2000 Tomizawa et al.
6,114,020 A * 9/2000 Misuda et al. ..... 428/32.35
6,114,022 A 9/2000 Warner et al.
6,162,517 A * 12/2000 Oshima et al. ..... 428/40.01
6,203,899 B1 * 3/2001 Hirose et al. ..... 428/32.25
6,245,710 B1 * 6/2001 Hare et al. ..... 503/201
6,255,363 B1 * 7/2001 Baker et al. ..... 523/201
6,316,120 B1 * 11/2001 Emslander ..... 428/522
6,357,871 B1 * 3/2002 Ashida et al. ..... 347/106
6,447,881 B1 * 9/2002 Nishida et al. ..... 428/195
6,550,909 B2 * 4/2003 Ichinose et al. ..... 347/105

FOREIGN PATENT DOCUMENTS

| | | |
|---|---|---|
| EP | 0605840 A2 | 7/1994 |
| EP | 0908324 A1 | 4/1999 |
| EP | 1078775 A2 | 2/2001 |
| WO | WO96/24642 | 8/1996 |

* cited by examiner

*Primary Examiner*—B. Shewareged
(74) *Attorney, Agent, or Firm*—Onofrio Law; Dara L. Onofrio, Esq.

(57) ABSTRACT

A recording material which comprises a polymeric substrate having two surfaces, wherein one surface is coated with a sealing layer comprising a particulate polymer having a film forming temperature of between 60° C. and 160° C. and an average particle size between 1 $\mu$m and 50 $\mu$m together with at least one binder, and at least one ink receiving layer; and the opposite surface is coated with an adhesive layer covered by a release liner. A related printing method whereby an image printed on the recording material is heated after printing to seal the sealing layer to provide a protected surface.

17 Claims, 1 Drawing Sheet

RECORDING MATERIAL AND METHOD

This application is a continuation-in-part of U.S. application Ser. No. 09/631,412 filed Aug. 3, 2000, now U.S. Pat. No. 6,811,253 which is incorporated herein by reference.

FIELD OF INVENTION

This invention relates to a recording material and to a method for the treatment of images produced therewith. More particularly it relates to a recording material and method for use with the ink jet recording system.

BACKGROUND OF THE INVENTION

The ink jet recording system is a printing and imaging method whereby fine droplets of ink are jetted under computer control and deposited on to a recording sheet such as a paper sheet to record images or letters. The ink jet recording system has features such as high speed and flexibility and is inexpensive and convenient, particularly in a case where the number of copies is relatively small. There is considerable interest in ink jet printing for various display purposes such as posters, billboards, vehicle graphics, and the like.

Hitherto ink jet prints for display purposes have been prepared by printing on to a recording medium having at least one ink-receiving layer formed on one side of a suitable support and an adhesive layer formed on the other side of the support, and a release sheet integrated thereto to cover the adhesive layer. The purpose of the receiving layer is to take up the ink rapidly and provide good image quality. The purpose of the adhesive layer is to attach the display to a suitable backing such as a support for a display or, in the case of vehicle graphics, to the body of the vehicle. The purpose of the release sheet or liner is to protect the adhesive until it is required for use. One problem with images produced using such materials is that they can be insufficiently robust to handling, and that the image or the receiving layer on which it is printed is sensitive to rubbing, scratching, and staining particularly when wet since the binder for the ink-receptive layer generally comprises water soluble or water swellable components.

Several methods of overcoming this poor robustness are known. For instance various additional coatings and treatments for ink receiving layers have been proposed, such as lacquers or varnishes which have to be applied after printing the image, thus requiring additional equipment. Another method of improving the robustness of printed images is by lamination, that is to say by covering them with a protective transparent overlay, which is commonly attached to the surface of the image receiving layer with an adhesive activated by heat, pressure, or both. This is particularly common for images intended for external display. The overlay acts as a physical protection for the image and seals it from ingress of water.

However lamination is expensive because additional materials are required together with additional handling and equipment, and there is considerable interest in finding a cheaper and simpler method of increasing the robustness of images produced using aqueous inks. We have devised an ink jet receiving material and method which provides images adequately robust for external display purposes.

SUMMARY OF THE INVENTION

In the present invention, these purposes, as well as others which will be apparent, are achieved generally by providing a recording material which comprises a polymeric substrate having two surfaces, where one surface is coated with a sealing layer comprising a particulate polymer having a film forming temperature of between 60° C. and 160° C. and an average particle size between 1 $\mu$m and 50 $\mu$m together with at least one binder; and at least one ink receiving layer; and the opposite substrate surface is coated with an adhesive layer which is protected by a release liner on top of the adhesive layer.

There is also provided a method for treatment of images on the recording material of the invention wherein the printed image is heated after printing to seal the layer comprising the particulate polymer to provide a robust image protecting coating. Preferably the printed image is heated under pressure with the image surface in contact with a second, inert sheet which is held against the image surface of the material by passing through a laminator.

Other objects, features, and advantages of the present invention will become apparent from the following detailed description of the invention when considered with reference to the drawings, as follows:

DETAILED DESCRIPTION OF THE INVENTION

Figure 1:
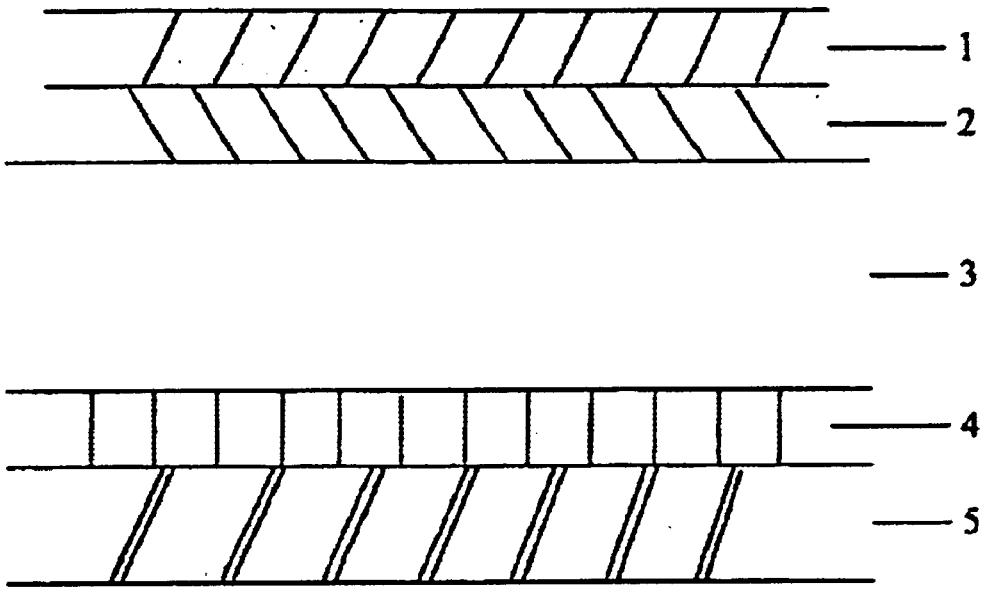
FIG. 1 shows a cross section through the recording material of the invention.

In accordance with the invention and as shown in FIG. 1, the recording material of the invention comprises a sealing layer 1 including the particulate polymer, an ink receiving layer 2 (which is also referred to as the pump layer and is used interchangeably herein), a substrate 3, an adhesive layer 4, and a release liner 5.

Suitable particulate polymers for the sealing layer 1 include any film-forming thermoplastics dispersion, for example a dispersion of polyurethane, low density polyethylene, high density polyethylene, polypropylene, polyvinyl acetate, polyvinyl acetate copolymers, styrene/butadiene copolymers, styrene/butadiene/acrylonitrile terpolymers, styrene/(meth)acrylate copolymers, (meth) acrylic polymers, ethylene/(meth)acrylic acid copolymers, ethylene/vinyl chloride copolymers, and mixtures thereof. A suitable average particle size for the particulate polymer is between about 1 $\mu$m and about 50 $\mu$m, with a particle size between about 5 $\mu$m and about 20 $\mu$m being preferable. The particulate polymer should have a melt flow index of at least 5, preferably between about 10 and about 100. A particularly suitable particulate polymer comprises low density polyethylene microspheres having an average diameter of about 12 $\mu$m and a melt flow index of 75. Another particularly suitable particulate polymer comprises microspheres of a 7% acrylic acid/polyethylene copolymer having an average diameter of about 10 $\mu$m and a melt flow index of 9. Another suitable particulate polymer comprises low density polyethylene particles of random shape and a particle size of about 13 $\mu$m and a melt flow index of 70. These polymers have melting points of 105–107° C.

Suitable binders for the sealing layer (1) include poly (vinyl alcohol), copolymers of poly (vinyl alcohol), carbohydrates such as tragacanth gum, or starch, modified carbohydrates such as hydroxyethyl cellulose or carboxymethyl cellulose, polyacrylates, poly (vinyl pyrrolidone), gelatin, casein and mixtures of such binders. A particularly suitable binder is poly (vinyl alcohol) which is hereinafter referred to as PVOH. It is to be understood that commercial samples of PVOH are normally prepared by hydrolysis of poly (vinyl acetate), and that this hydrolysis does not always go to completion. Thus a preferred binder is PVOH having a degree of hydrolysis of at least 85%, and a particularly preferred binder is PVOH having a degree of hydrolysis of approximately 88%.

The coating weight of the sealing layer and the weight ratio between the polymeric particles and the binder may be determined by the desired image quality, gloss, and robustness of the final print. A suitable coating weight for the sealing layer is from about 15 to about 40 $gm^{-2}$. A preferred coating weight is between about 15 and about 25 $gm^{-2}$. The ratio of the coating weight of the particulate polymer to that of the hydrophilic binder may be from about 20:1 to about 1:1, but preferably is between about 10:1 and about 5:1.

The ink receiving layer 2 to be formed on the support may comprise any of the known ink receiving layers known in the art. Preferably the ink receiving layer (2) is formed by a composition comprising at least one white pigment or filler and a suitable polymeric binder as the main components. Suitable white pigments and fillers include conventional white inorganic pigments and starch particles. Examples of white inorganic pigments are light calcium carbonate, heavy calcium carbonate, kaolin, talc, calcium sulphate, barium sulphate, titanium dioxide, zinc oxide, zinc sulphide, zinc carbonate, satin white, aluminium silicate, diatomaceous earth, calcium silicate, magnesium silicate, synthetic non-crystalline silica, colloidal silica, colloidal alumina, pseudo boehmite, aluminium hydroxide, alumina, lithopone, zeolite, hydrolyzed halloysite, magnesium carbonate, magnesium hydroxide, clays and the like. Among the above pigments, a porous inorganic pigment is preferred, such as porous non-crystalline synthetic silica, porous magnesium carbonate, or porous alumina. Porous synthetic non-crystalline silica having a large pore volume is particularly preferred.

The polymeric binder to be used for the ink receiving layer 2 of the present invention may, for example, be starch or a starch derivative such as oxidized starch, etherified starch or phosphated starch; a cellulose derivative such as carboxymethyl cellulose or hydroxyethyl cellulose; casein, gelatin, tragacanth gum, soybean protein, a polyacrylate, poly (vinyl alcohol), a copolymer of poly (vinyl alcohol), poly (vinyl pyrrolidone), and mixtures of such binders, of which hydrophilic acrylate binders are preferred.

Optionally the ink receiving layer may also contain a basic or cationic polymer. The cationic or basic polymer may comprise a polymer incorporating primary, secondary, or tertiary amino groups or typical cationic groups such as quaternary ammonium salts. The polymer may, for example, be a polyalkylene polyamide, a ring-opened polymer of ethyleneimine, a homopolymer of a cationic vinyl polymer or a copolymer thereof with another polymerizable monomer, a homopolymer of a basic nitrogen containing acrylate or other vinyl monomer or a copolymer thereof with another polymerisable monomer. A preferred polymer is a copolymer of vinyl imidazole with vinyl pyrrolidone.

The coating weight of the pump layer may be determined by the quantity of ink to be printed. A suitable coating weight for the pump layer is from about 5 to about 50 $gm^{-2}$. A preferred coating weight for the ink receiving layer is from about 15 to about 40 $gm^{-2}$.

Further, it is possible to provide two or more ink-receiving layers on the support.

The heat sealing layer and receiving layer or layers of the invention may advantageously also comprise additives which are commonly added to ink receiving layers such as surfactants to improve coating quality, cross linking agents, optical brightening agents, tinting agents, and biocides or preservatives. Suitable cross linking agents for the preferred poly (vinyl alcohol) binders of the invention include boric acid and aldehydes such as glyoxal or glutaraldehyde.

Suitable polymeric substrates 3 for the materials of the invention include any of those commonly used for printing and imaging media, especially cellulose acetates, poly (ethylene), poly(propylene), poly (vinyl chloride), and polyesters including poly (ethylene terephthalate), poly (butylene terephthalate), and poly (ethylene naphthalate). Opaque substrates such as voided polyester and poly vinyl chloride are particularly useful. A preferred substrate is poly (vinyl chloride). The substrate may contain other additives as are known in the art. It is especially preferred to use plasticisers such as phthalate esters, phosphate esters, or polymeric plasticisers and stabilisers such as tin stabilisers and lead stabilisers with the preferred poly (vinyl chloride) substrates of the invention.

Suitable adhesives 4 include solvent type and aqueous type adhesives. Aqueous adhesives of the emulsion type obtained by emulsion polymerisation in water employing a surface active agent are well known. Preferably the adhesive 4 is a pressure sensitive organic solvent type adhesive such as a rubber type adhesive or an acrylic resin type adhesive. The main material of the rubber-type adhesive is natural rubber or styrene-butadiene rubber. To the natural rubber, a resin or a plasticiser may be incorporated, and a suitable solvent for coating such as n-hexane. The acrylic resin type adhesive may be prepared by polymerising an acrylic monomer such as 2-ethylhexyl acrylate, butyl acrylate, ethyl acrylate, or β-hydroxyethyl acrylate, in an organic solvent. Further, in order to improve the physical properties such as the heat resistance and the solvent resistance of the adhesive, a cross linking agent of isocyanate type, melamine type or metal chelate type may be reacted to the above material for the cross linking reaction, or a pigment such as silica, kaolin, clay, calcium carbonate, aluminium hydroxide, zinc oxide, titanium dioxide, melamine resin particles or starch particles, may be incorporated to the above material. Depending upon the particular purpose for which the ink jet recording sheet is employed other additives may be incorporated in the adhesive layer 4 including a water soluble polymer, a petroleum type resin, a paraffin wax, a fatty acid or its derivative, a higher alcohol, a metal soap, or a silicone as well as an antistatic agent, a thickener, a dispersant, a preservative, an antioxidant or a defoaming agent.

Suitable materials for the release sheet 5 include wood free paper, kraft paper, glassine paper, impregnated paper, or a plastic film such as a polyester film or a polyamide film. These may be coated with a silicone resin or ptfe as a release agent. In the case of a paper type base material, a thermoplastic resin may preferably be laminated on the base material to form a smooth surface so as to improve the peeling properties. Preferably the release sheet is a siliconised plain kraft paper weighing about 100 $gm^{-2}$. The release sheet is releasably adhered to the rest of the material, and is selected on such a basis that the release sheet has an adhesive force sufficiently strong not to be peeled during transportation in an ink jet recording apparatus or during sealing of the heat sealing layer but weak enough to peel easily when it is desired to attach the printed image to its display panel.

Although other methods for the preparation of the materials of the present invention are possible, it is preferable to employ a method wherein the image receiving layer or layers 2 together with the sealing layer 1 are coated either simultaneously or separately on to a material comprising the substrate 3, the adhesive layer 4, and the release sheet 5. Alternatively the sealing layer 1 may be coated on to a existing ink jet medium which comprises the release liner 5, adhesive layer 4, substrate 3, and image receiving layer or layers 2. Any convenient coating method may be used for the preparation of the materials of the present invention, such as blade coating, knife coating, and slide coating.

It may be advantageous to treat the surface of the substrate 3 to assist adhesion of the image receiving layer 2. This treatment may take the form of a surface modification technique such as flame or corona treatment, buffing, or the like, but preferably may involve the application of a chemical priming or subbing layer. Such adhesion promoting treatments are well known.

Any convenient ink jet printer may be used for printing on the materials of the invention, for example a continuous printer or a piezoelectric or thermal drop-on-demand printer. Suitable jetting inks include aqueous inks and those based on organic solvents such as 2-butanone (MEK), ester solvents, and mineral oils. Suitable colorants for these inks include dyes or pigments. Preferred inks for the invention are pigmented aqueous inks.

The recording materials of the invention may also be used with other printing methods as are known in the art, or as writing or drawing materials for use with felt tip pens and the like.

The materials of the invention are particularly suitable for use in a printing process wherein the printed image is heated after printing to seal the sealing layer to provide a robust image protecting coating.

Therefore according to this aspect of this invention, the printed image is heated after printing to seal the sealing layer. The heating process may use any convenient method, such as heated air, contact with a heated surface, or infra red or microwave radiation. Alternatively the print may be heated under pressure in contact with a heated surface or by passing it between heated rollers. A suitable temperature is between about 80° C. and about 180° C., preferably between about 100° C. and about 120° C.

It is important that the components of the substrate, adhesive layer, and release liner are not affected by this heating process. One of the advantages of the preferred particulate polymers of the heat sealing layer of the invention is that the softening points are relatively low and thus the temperature and time needed to seal them are minimised.

According to another aspect of the invention, the printed image is heated under pressure with the image surface in contact with a second, inert sheet which is held against the image protective layer of the material. The inert sheet does not adhere to the material, but protects it from the means used to apply the pressure. Suitable inert sheets include polyester films, polyamide films, and casting papers. The inert sheet may be treated with silicones or ptfe to enhance the release properties. Furthermore a suitable choice of the inert sheet may be used to produce a desired appearance to the final image such as the use of a smooth inert sheet which will impart a high gloss to the image or a textured sheet which will produce a textured finish.

Preferably according to this aspect of this invention, the printed image is heated by passing through a laminator. By laminator is meant a device which is normally used for the lamination of printed images which comprises a means of heating and pressing together the image and the cover sheet, commonly by passing them through a nip between a pair of heated rollers.

It is believed that the dye or pigment components of the ink are substantially retained within the sealing layer after printing, thus separating them from the liquid ink vehicle which is largely transferred to the pump layer. The colorant components then become encapsulated within the sealing layer after heating.

The materials and method of this invention are suitable for many uses where robustness of an ink jet image is important, such as posters, displays, vehicle graphics, and the like.

The following Examples will serve to illustrate the invention. These examples are merely representative and are not inclusive of all the possible embodiments of the invention.

EXAMPLE 1

A material according to the invention was prepared as follows. A support comprising a monomerically plasticised polyvinyl chloride substrate, an acrylic, water based pressure sensitive adhesive layer, and a 100 $gm^{-2}$ siliconised plain kraft paper release sheet was coated with the following layers in order:

(a) An adhesion promoting layer formulated using the following components listed in Table I below.

TABLE I

| Component | Quantity |
|---|---|
| Acrylic modified polyurethane dispersion | 900 g |
| Aziridine cross linker | 8 g |
| Siloxane surfactant | 2 g |
| Water | 90 g |

The polyurethane dispersion was from Zeneca under the trade name Neorez R973 and the cross linker from Zeneca under the trade name CX100. The surfactant was a commercial sample from Byk chemie under the trade name Byk 348.

The total solid concentration of the formulation was 37%. It was coated to give a coating weight of 2 $gm^{-2}$.

(b) An ink receiving (pump) layer was formulated using the following components listed in Table II below.

TABLE II

| Component | Quantity |
|---|---|
| Synthetic silica | 95.3 g |
| Siloxane surfactant as for adhesion layer | 1.5 g |
| Acrylic solution polymer | 212.6 g |
| PVI/PVP polymer | 212.6 g |
| Water | 478.0 g |

The synthetic silica had a particle size of 12 $\mu$m available under the trade name of Sylojet P412 from Grace Davidson. The acrylic polymer was from Worlee under the trade name of Worlecryl 8040. The PVI/PVP polymer is a vinyl imidazole/vinyl pyrrolidone copolymer from BASF under the trade name Luvitec VP 155K72W.

The total solid concentration of the formulation was 22·42%. It was coated to give a coating weight of approximately 30 $gm^{-2}$.

(c) A heat sealing layer was formulated using the following components listed in Table III below.

TABLE III

| Component | Quantity |
|---|---|
| 99% PVOH 10% solution | 400 g |
| Siloxane surfactant as for adhesion layer | 2 g |
| Acrylic modified polyethylene beads | 250 g |
| Water | 478 g |

The poly (vinyl alcohol) was from Harco under the trade name of Mowiol 28-99. The acrylic modified polyethylene beads were from Sumitomo under the trade name EA209 flowbeads.

The total solid concentration of the formulation was 29·2%. It was coated to give a coating weight of approximately 29 $gm^{-2}$.

A test pattern was printed on the material using ILFORD Archiva Extreme pigmented aqueous inks on a Novajet III printer. The image was sealed by passing it through a Seal 600 laminator with the image face in contact with a 125 $\mu$m thickness smooth polyester film available under the trade name Melinex O. A bright, glossy image was produced, resistant to water and rubbing.

EXAMPLE 2

A sample of the material produced in Example 1 was printed with ILFORD Archiva dyed aqueous inks using an Epson Pro E printer and sealed as in Example 1. A bright glossy image was produced, resistant to water and rubbing.

EXAMPLE 3

A sample of the material produced in Example 1 was printed using aqueous inks on an Epson 3000 desktop printer. The image was sealed using a GBC 1200 desktop laminator at a set temperature of 120° with the image face in contact with a smooth polyester film as in Example 1. A bright glossy image was produced, resistant to water and rubbing.

EXAMPLE 4

A sample of the material produced in Example 1 was printed with mineral oil based inks according to PCT WO 96/24642 and sealed as in Example 3. A bright glossy image was produced, resistant to water and rubbing.

EXAMPLE 5

A recording material according to the invention was prepared as follows:

The support comprised a polymerically plasticised cast polyvinyl chloride, an acryic waterbased pressure sensitive adhesive layer and a 100 $gm^{-2}$ siliconised plain kraft paper release sheet.

(a) The adhesion layer was used as in Example 1.

(b) An ink receiving (pump) layer similar to that in Example 1 but with modified proportions as listed in Table IV below.

TABLE IV

| Component | Quantity |
|---|---|
| Synthetic silica | 111.5 g |
| Siloxane surfactant | 2.2 g |
| Acrylic solution polymer | 310.3 g |
| PVI/PVP polymer | 185.7 g |
| Water | 390.3 g |

The total solid content of the mixture was 22.5%. On this occasion the acrylic polymer was the grade known by the trade name Worlecryl 8025.

(c) The heat sealing layer was formulated as listed in Table V below.

TABLE V

| Component | Quantity |
|---|---|
| PVOH(30%) solution | 124.3 g |
| Siloxane surfactant | 2.0 g |
| Polyethylene beads | 310.8 g |
| Water | 562.9 g |

The polyvinyl alcohol was obtained from Harco under the trade name of Mowiol 4-88. The polyethylene beads were manufactured by Dupont under the trade name Coathylene and have a mean particle size of 6 $\mu$m. The solid concentration of the formulation was 35%.

The three layers were coated simultaneously onto the substrate using the slide bead coating technique. Coating weights (as solid) of the three layers were: (a) 4 $gm^{-2}$; (b) 12 $gm^{-2}$; and (c) 18 $gm^{-2}$.

A test pattern was printed and the image sealed as in Example 1. A bright, glossy image was produced, resistant to water and rubbing, and which could be adhered to an uneven surface without compromising the quality of the image.

The foregoing description of various and preferred embodiments of the present invention has been provided for purpose of illustration only, and it is understood that numerous modifications, variations and alterations may be made without departing from the scope and spirit of the invention as defined in the appended claims hereto.

What is claimed is:

1. A recording material which comprises a polymeric substrate having two surfaces, wherein one surface is coated with a sealing layer comprising a particulate polymer having a film forming temperature of between 60° C. and 160° C. and an average particle size between 1 $\mu$m and 50 $\mu$m together with at least one binder; and at least one ink receiving layer; wherein said sealing layer is on top of said ink receiving layer; and the opposite surface is coated with an adhesive layer.

2. The recording material according to claim 1, wherein a release liner is on top of said adhesive layer.

3. The recording material according to claim 1 wherein the particulate polymer has an average particle size between 5 $\mu$m and 20 $\mu$m.

4. The recording material according to claim 1 wherein the particulate polymeric dispersion comprises low density polyethylene.

5. The recording material according to claim 1 wherein the binder for the sealing layer is selected from the group consisting of polyvinyl alcohol, a copolymer of polyvinyl alcohol, tragacanth gum, casein, starch, hydroxyethyl cellulose, carboxymethyl cellulose, a polyacrylate, poly vinyl pyrrolidone, and gelatin.

6. The recording material according to claim 1 wherein said ink receiving layer comprises at least one white pigment and a polymeric binder.

7. The recording material according to claim 6 wherein the white pigment is selected from the group consisting of calcium carbonate, kaolin, talc, calcium sulphate, barium sulphate, titanium dioxide, zinc oxide, zinc sulfide, zinc carbonate, satin white, aluminium silicate, diatomaceous earth, calcium silicate, magnesium silicate, synthetic non-crystalline silica, colloidal silica, colloidal alumina, pseudo boehmite, aluminium hydroxide, alumina, lithopone, zeolite, hydrolyzed halloysite, magnesium carbonate, magnesium hydroxide, clays and the like.

8. The recording material according to claim 1 wherein the polymeric substrate is cellulose acetate, poly(ethylene), poly(propylene), poly (vinyl chloride), poly (ethylene terephthalate), poly (butylene terephthalate), and poly (ethylene naphthalate).

9. The recording material according to claim 1 wherein the polymeric substrate is opaque.

10. The recording material according to claim 9 wherein the opaque polymeric substrate is plasticised polyvinyl chloride.

11. The recording material according to claim 2 wherein the release liner comprises kraft paper, glassine paper, impregnated paper, polyester film, or polyamide film.

12. A printing method whereby an image printed on a recording material, wherein said recording material comprises a polymeric substrate having two surfaces, wherein one surface is coated with a sealing layer comprising a particulate polymer having a film forming temperature of between 60° C. and 160° C. and an average particle size between 1 $\mu$m and 50 $\mu$m together with at least one binder, and at least one ink receiving layer between said sealing layer and said polymeric substrate; and the opposite surface coated with an adhesive layer; wherein the recording material is heated after printing to seal the sealing layer to provide a protective surface.

13. The printing method according to claim 12, wherein a release liner is on top of said adhesive layer.

14. The printing method according to claim 12 whereby the material is heated to between 80° C. and 180° C.

15. The printing method according to claim 12 whereby the material is printed using the ink jet printing process.

16. The printing method according to claim 12 whereby the printed material is heated under pressure with the image surface in contact with a second, inert sheet which is held against the image protective layer of the material.

17. The printing method according to claim 16 whereby the printed material and inert sheet are heated under pressure by passing them through a laminator.

* * * * *